United States Patent [19]

Hutterer

[11] 4,013,170

[45] Mar. 22, 1977

[54] SHIPPING CONTAINER

[75] Inventor: Karl Hutterer, Neugermering, Germany

[73] Assignee: Dornier System GmbH, Friedrichshafen, Germany

[22] Filed: Jan. 12, 1976

[21] Appl. No.: 648,260

[30] Foreign Application Priority Data

Jan. 18, 1975 Germany ..... 2501913

[52] U.S. Cl. ..... 206/521; 206/525; 217/54; 220/15; 248/18; 248/22; 248/358 R

[51] Int. Cl.² ..... B65D 81/10; B65D 85/30

[58] Field of Search .... 248/358 R, 358 A, 358 AA, 248/17, 18, 20, 22; 217/27, 35, 52, 54; 220/9 A, 9 LG, 15; 206/521, 525

[56] References Cited

UNITED STATES PATENTS

| | | | |
|---|---|---|---|
| 1,016,077 | 1/1912 | Lumley | 217/54 |
| 2,494,170 | 1/1950 | Goldfield et al. | 248/358 AA |
| 2,524,413 | 10/1950 | Migula | 248/17 |
| 2,531,543 | 11/1950 | Sutphen | 217/52 |
| 2,615,707 | 10/1952 | Rowe et al. | 217/54 |
| 2,799,778 | 7/1957 | Stephenson | 217/54 |
| 3,540,688 | 8/1967 | Schulte | 248/18 |
| 3,823,903 | 7/1974 | Kendall et al. | 248/18 |
| 3,844,203 | 10/1974 | Takahashi | 220/15 |

FOREIGN PATENTS OR APPLICATIONS

| | | | |
|---|---|---|---|
| 492,982 | 7/1919 | France | 217/54 |
| 1,188,380 | 3/1965 | Germany | 248/358 |
| 1,001,757 | 8/1965 | United Kingdom | 521/ |
| 901,507 | 7/1962 | United Kingdom | 206/521 |
| 677,326 | 8/1952 | United Kingdom | 217/54 |

*Primary Examiner*—Steven E. Lipman
*Assistant Examiner*—Bruce H. Bernstein
*Attorney, Agent, or Firm*—Hans Berman

[57] ABSTRACT

A shipping container of molded plastic in whose cavity a load is suspended between sets of three rubber straps diverging from the load toward respective rigid base members on the shell in angularly offset planes, the central strap of each set being less resilient than the two other straps. The straps impede transmission of mechanical shock from the shell to load, and their different resiliencies prevent build-up of load oscillations. The shell protects the load against harmful effects of the atmosphere.

10 Claims, 8 Drawing Figures

SHIPPING CONTAINER

This invention relates to shipping containers, and particularly to a shipping container in which a load may be resiliently suspended so as to float in the shell cavity.

It is common practice to pack delicate scientific instruments or electronic devices in containers together with cushioning material which limits relative movement of the load and the container and absorbs mechanical shock. The protection afforded to the load by cushioning material is limited at best, and ineffective unless the cushioning material conforms closely to the load or is placed about the load by skilled workers. It is also known to float delicate loads in a rigid container by means of resilient hangers, such as springs. Under unfavorable conditions, a load suspended from resilient hangers may be induced to oscillate at the natural frequency of the system with an amplitude sufficient for collision with the container walls and for consequent damage to the load. If provisions are made for damping such oscillations, the package becomes complex, and its assembly requires special skill.

It is an object of the invention to provide a shipping container in which a sensitive load is protected against mechanical damage due to shock or oscillations and which is simple and foolproof.

With this object and others in view, as will hereinafter become apparent, the shipping container of the invention includes a shell of releasably connected parts and a plurality of elongated, rigid base members mounted in the cavity of the shell in spaced relationship. A set of three elongated, resilient tension elements is associated with each base member, each tension element having first and second, longitudinally terminal portions. Three first fastening devices are longitudinally spaced on each base member and respectively fasten the first longitudinally terminal portions of the associated tension elements to the base member, the tension elements fastened to the base member by the two outer fastening devices of each set being more resilient than the tension element fastened to the base member by the central fastening device. Second fastening devices may fasten the second longitudinally terminal portions of the tension elements associated with each base member to each other and to a load suspended in the cavity by the tension elements. The tension elements associated with the same base member converge from the first fastening devices toward the second fastening device when fastened to each other.

Other features, additional objects, and many of the attendant advantages of this invention will readily be appreciated as the same becomes better understood from the following detailed description of a preferred embodiment, and of variations thereof, when considered in connection with the appended drawing in which.

Figure 1:
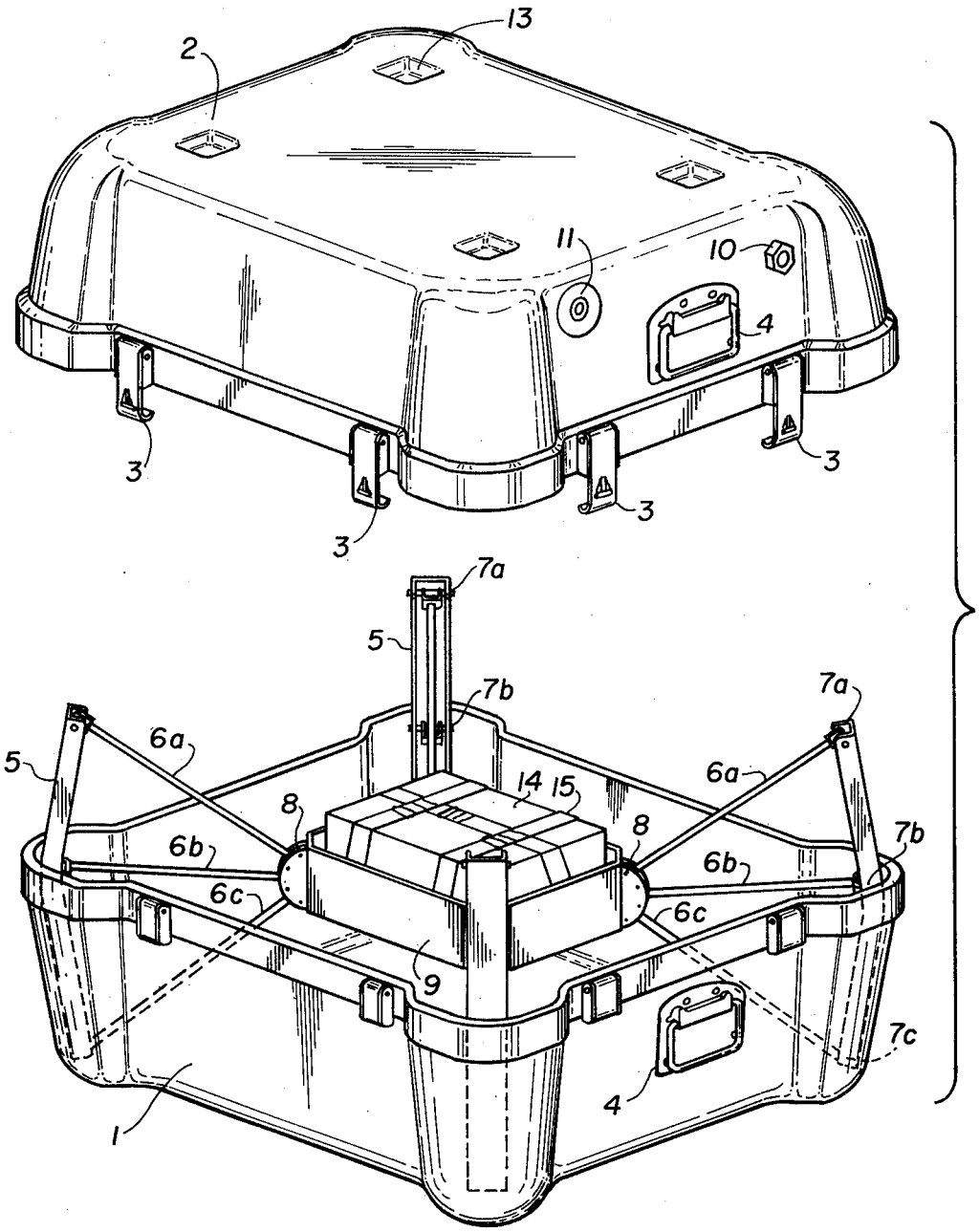
FIG. 1 shows an open shipping container of the invention in a perspective view.
Figure 2:
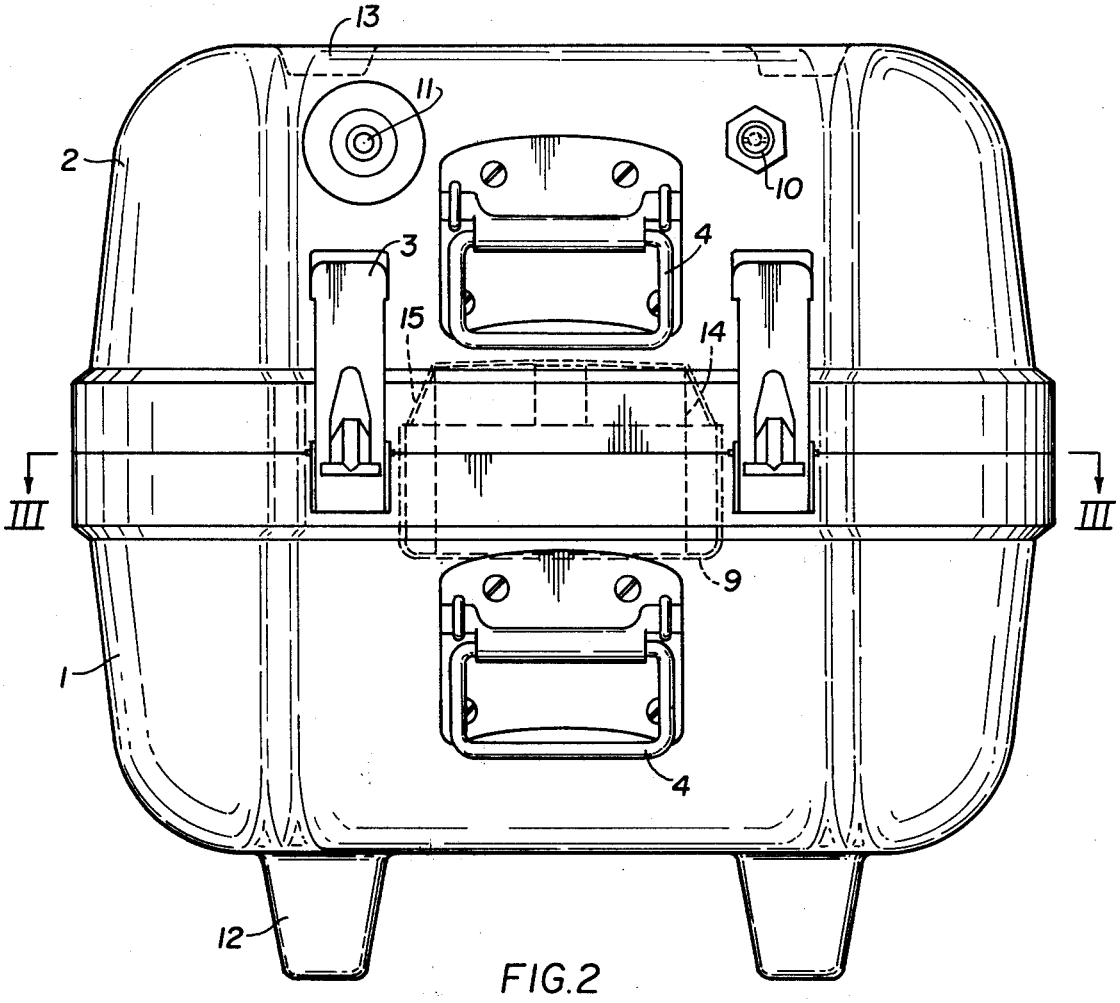
FIG. 2 shows the container of FIG. 1 in the closed condition in elevation.

Referring now to the drawing in detail, and initially to FIG. 1, there are shown the bottom part 1 and the cover part 2 of a container shell of glass-fiber reinforced plastic. Each shell portion has the shape of a frustum of a pyramid whose rectangular larger base is open, the smaller base being closed by a top or bottom wall. Toggle clamps 3 on the reinforced rim of the cover part 2 may engage the rim of the bottom part 1 to seal the cavity of the shell as is shown in FIG. 2. Handles 4 are provided on the side walls of both shell portions 1, 2.

Steel channels 5 are fastened along the four side edges of the bottom part 1 and project into the cover part 2 of the closed shell. Each channel 5 is bent at an obtuse angle so that its apex is located in the plane of contact between the assembled shell portions, and the two legs of each channel conformingly extend along respective side edges of the two shell portions.

The channels 5 are the rigid base members of suspension units also including respective sets of three resilient tension elements 6*a*, 6*b*, 6*c* fastened to the associated channel 5 by respective outer fasteners 7*a*, 7*b*, 7*c* spaced along the channel, the fastener 7*b* being located at the apex of the channel, and the fasteners 7*a*, 7*c* at the free ends of the channel legs. The three tension elements associated with each channel 5 converge toward a common inner fastener 8 fastening the elements of the set to each other and to a respective one of four, approximately parallel edges of a carrier 9 which will presently be described in more detail.

Figure 3:
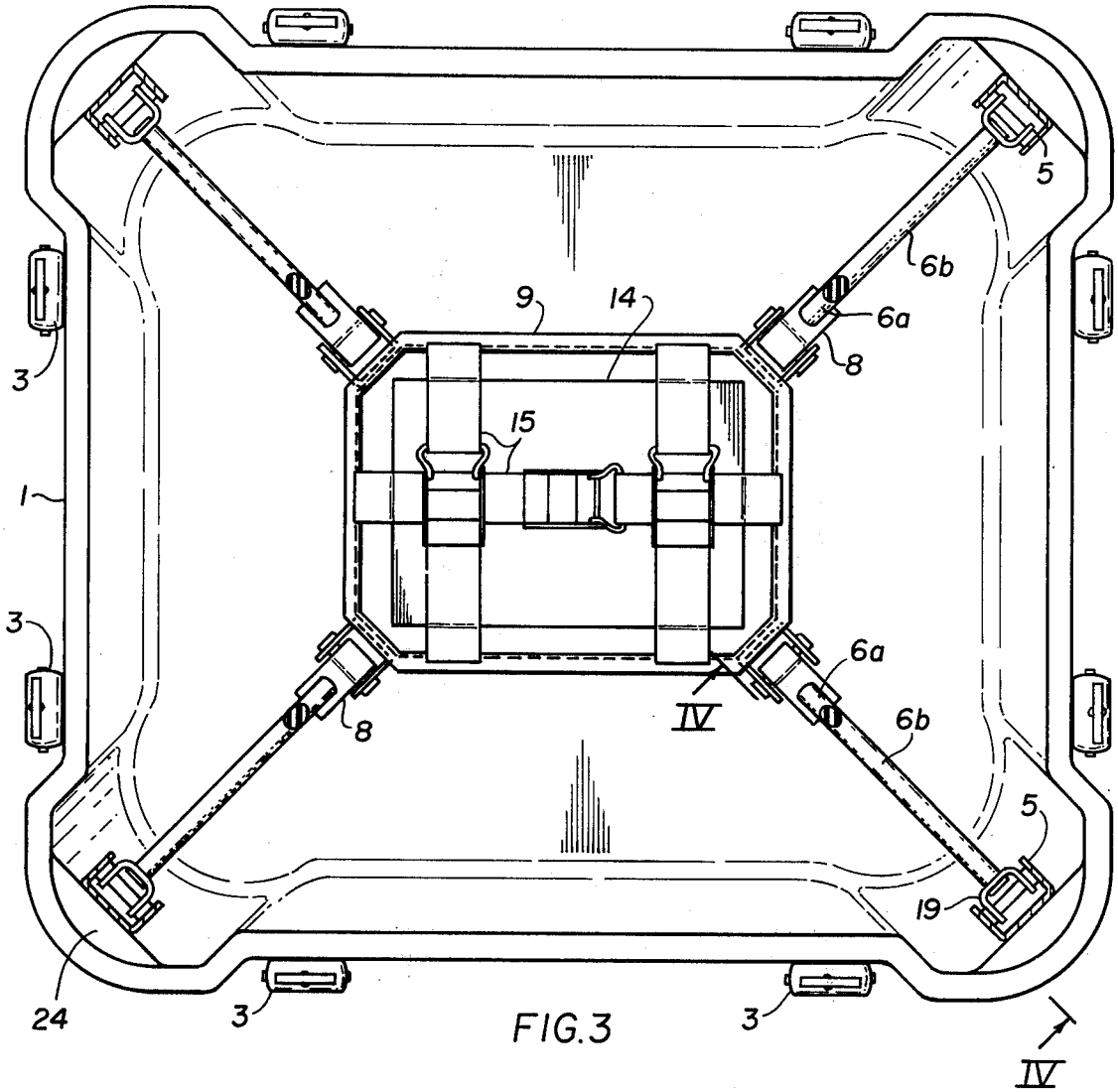
FIG. 3 illustrates the bottom part of the container of FIG. 2 in top plan view and partly in section on the line III—III.

As is better seen in FIGS. 2 and 3, the side edges of the bottom part 1 and of the almost identical cover part 2 project beyond planar main portions of the side walls so as to determine the overall contours of the shell. The clamps 3 and handles 4 are recessed behind the side edges and protected thereby. Integral ribs 24 of glass fiber filled plastic extend along the side edges of the two shell parts to reinforce the same.

A vent 10, conventional in itself, is threadedly mounted in the cover part 2. It has an axial bore open toward the shell cavity and a transverse bore which normally communicates with the atmosphere, but may be sealed by moving the vent 10 inward of the shell. A humidity indicator arranged in the cover part 2 may be viewed through a transparent window 11 of the shell. As seen in FIG. 2, the closed container shell rests on four projecting feet 12 integrally molded with the bottom part 1. The cover part 2 has four recesses 13 dimensioned and positioned to receive the feet 12 of another container shell so that several shells may be stacked conveniently.

The carrier 9 is a four-sided box open in an upward direction. The actual load 14, in this instance a delicate instrument encased in a cardboard box, is fastened to the carrier 9 by straps 15 of adjustable length, conventional in themselves.

Figure 4:
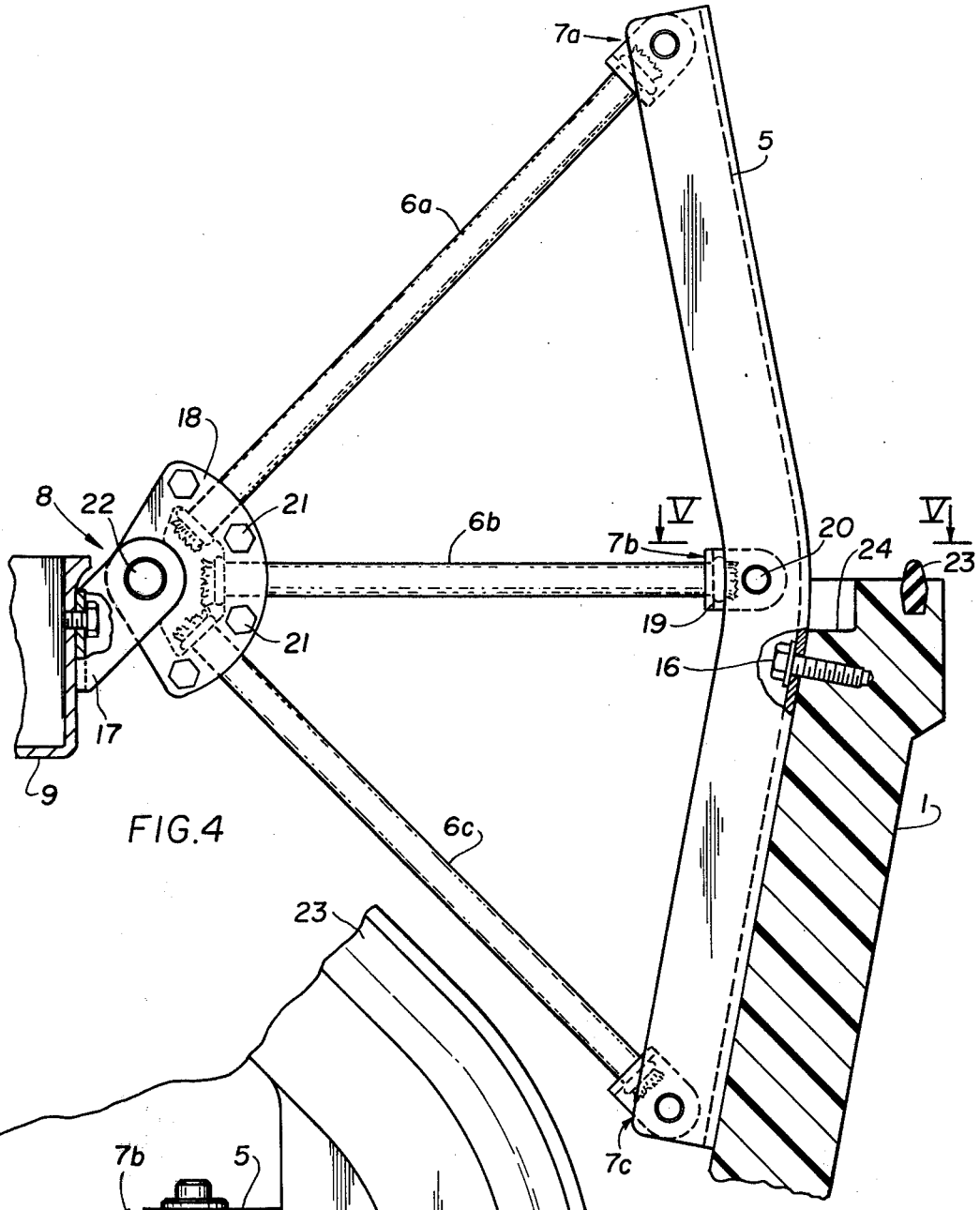
FIG. 4 is an elevational, enlarged view of a portion of the device of FIG. 3 taken in section on the line IV—IV.

As is partly shown in FIG. 4, each channel 5 is releasably fastened to a reinforcing rib 24 by several mounting screws 16. The tension elements 6*a*, 6*b*, 6*c* are straps of oxidation resistant, synthetic rubber or other elastomer which converge toward the common inner fastener 8 in a common plane, the several sets of tension elements being located in respective angular offset planes intersecting each other in the carrier 9, as in evident from FIG. 3.

Figure 5:
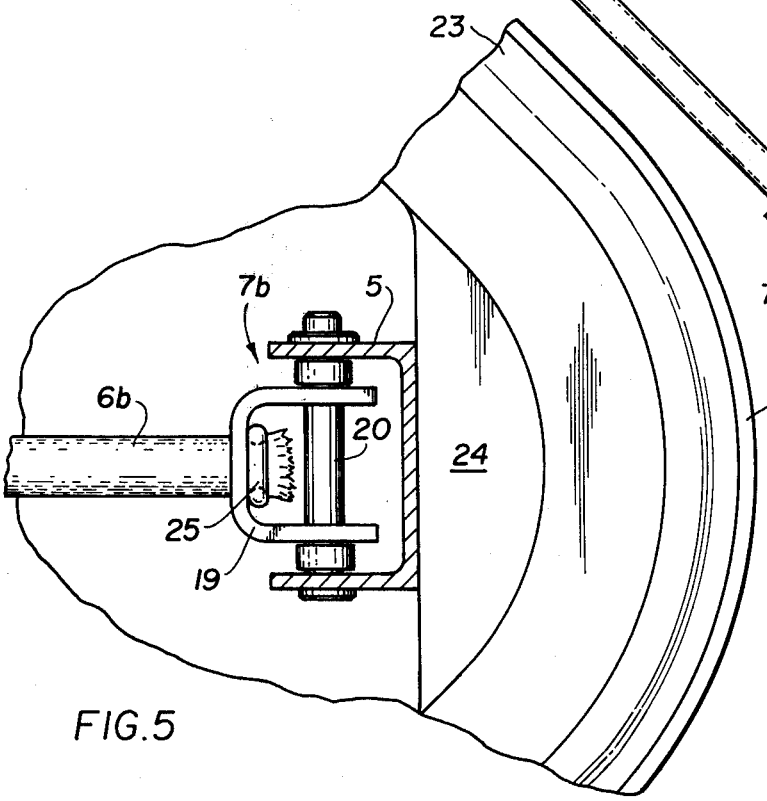
FIG. 5 shows a portion of the device of FIG. 3 on a scale greater than that of FIG. 4.

The three fasteners *7a*, *7b*, *7c* are identical, the fastener *7b* being shown in detail in FIG. 5. It includes a U-shaped strap or stirrup 19 mounted between the flanges of the associated channel 5 by a pivot pin 20 passing through the leg portions of the strap 19. An opening in the bight portion of the strap 19 receives the tension element *6b* whose free end is retained in the strap 19 by an annular clamp 25.

Figure 6:
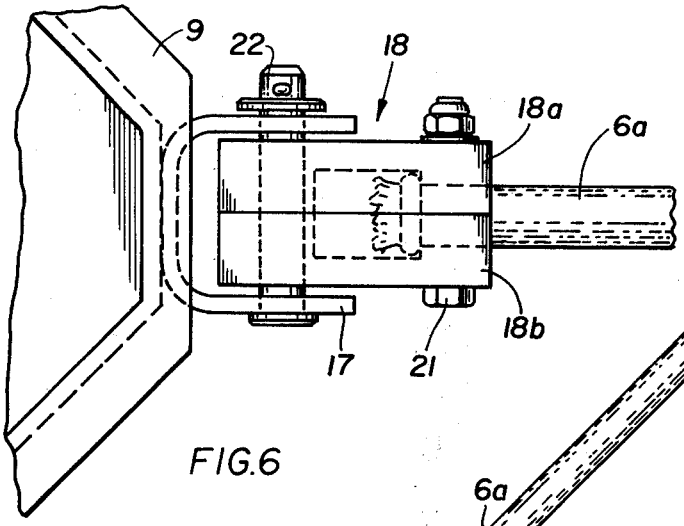
FIG. 6 is a top plan view of a portion of the device of FIG. 4 on a larger scale.

The fastener 8 which connects the three tension elements *6a*, *6b*, *6c* to the carrier 9 includes a connector 18 assembled from two segment-shaped discs *18a*, *18b* fastened to each other by a bolt 21 as is shown in FIG. 6. The tension elements *6a*, *6b*, *6c* enter a cavity in the connector 18 through respective orifices, and are retained in the cavity by clamping rings as described with reference to FIG. 5. A pivot pin 22 attaches the connector 18 to a U-shaped strap or stirrup 17 which in turn is riveted to the carrier 9, as is shown in FIG. 4.

The closed shell 1, 2 is hermetically sealed by a synthetic rubber gasket 23 inserted in the rim of the bottom part 1 (FIGS. 4, 5) when the vent 10 is closed. If necessary, the cavity of the shell may thus be flushed with dry air or a dry inert gas or evacuated through the vent 10 before being sealed, and the functioning of the seal may be monitored by inspecting the humidity indicator through the window 11.

The load supported on the floating carrier 9 will be adequately protected against transmission of shock from the shell 1, 2 over a range determined by the elastic properties of the tension elements *6a*, *6b*, *6c*, and experience with actual embodiments of the invention indicates that the same four sets of rubber straps may be used successfully with loads varying in weight over a range whose maximum value is approximately ten times the minimum value. The container may be adapted to loads outside this range by releasing the screws 16 which hold the four suspension units consisting of respective ribs 5, sets of tension elements *6a*, *6b*, *6c*, and fasteners *7a*, *7b*, *7c*, 8 and substituting other suspension units having stronger or weaker tension elements.

Excessive oscillation of the carrier 9 is prevented by the different elastic properties of the tension elements *6a*, *6b*, *6c* in each set. The elements are stressed under tension when in the operative condition shown in FIG. 4, but the two outer elements *6a*, *6c* are more resilient than the central element *6b*. Because of the obtuse angle at which the two legs of the channel 5 are offset relative to each other, the elements *6a*, *6c* are only slightly longer than the central element *6b*, and the difference in length is not sufficient in itself to provide the desired difference in elasticity. If made from the same elastomeric material, the central elements *6b* must be increased in cross section for reduced resiliency, but it is preferred to make the elements *6b* of an elastomer having a higher modulus of elasticity than that of the elements *6a*, *6c*, so that the three elements may be of approximately equal cross section for assembly with identical stirrups 19 and clamps 25.

Figure 7:
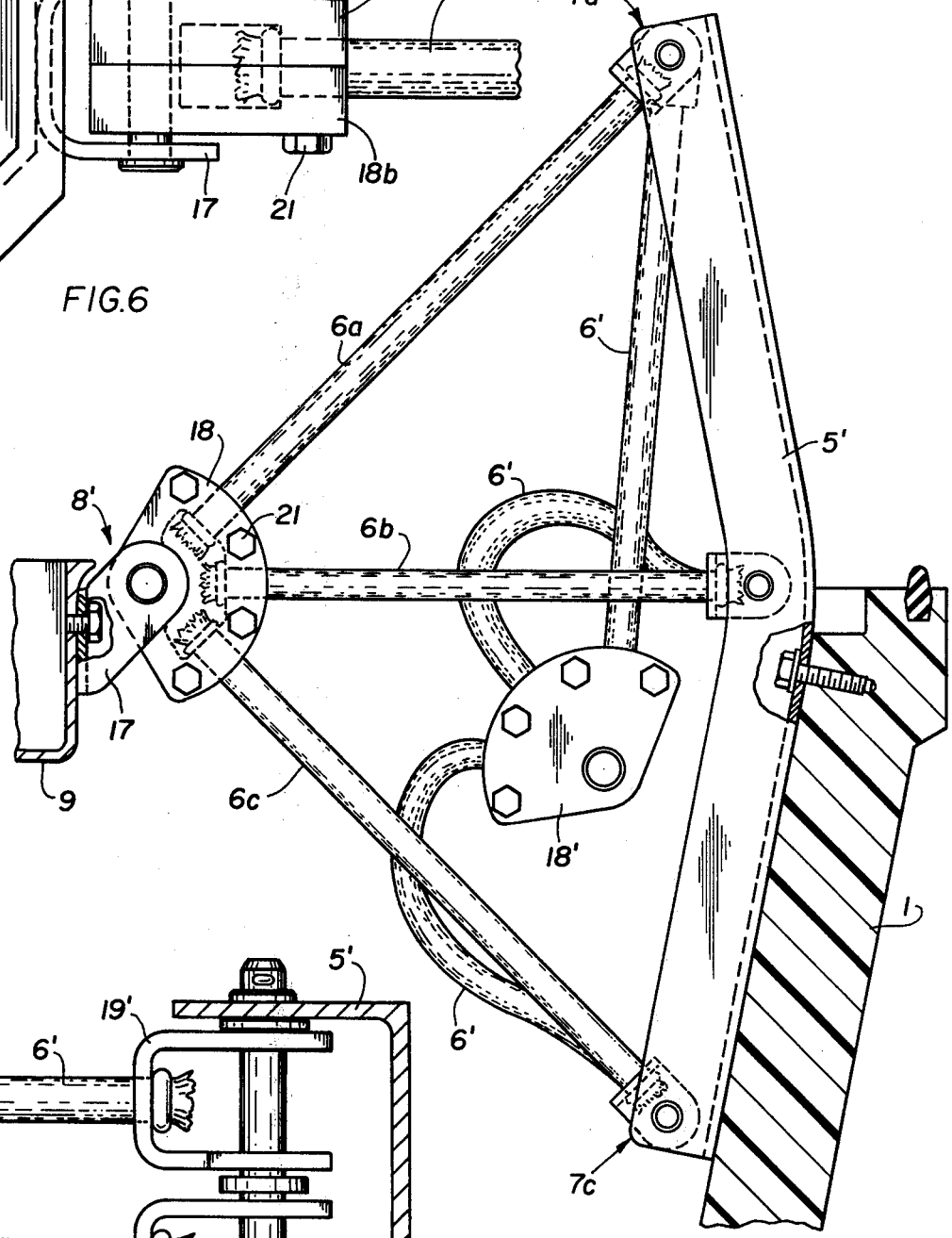
FIG. 7 illustrates a partly modified container in a view corresponding to that of FIG. 4.
Figure 8:
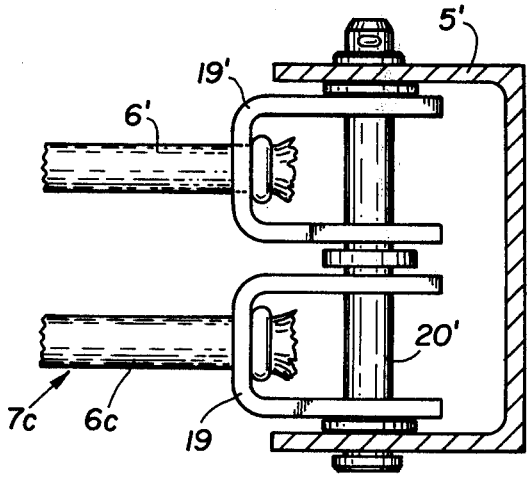
FIG. 8 shows the device of FIG. 7 in the manner of FIG. 5.

If the same shipping container of the invention is to be used often with loads varying in weight by a factor of more than ten, it is preferably modified in the manner shown in FIGS. 7 and 8 to avoid frequent replacement of entire suspension units. The container partly seen in FIGS. 7 and 8 is identical with the container described with reference to FIGS. 1 to 6 as far as not explicitly shown and described otherwise.

The sets of tension elements *6a*, *6b*, *6c* are each supplemented in the modified container by a group of tension elements 6′. The webs of the channels 5′ in each suspension unit are so wide that each channel can accomodate a second stirrup 19′ fastening a longitudinally terminal portion of a tension element 6′ to the common pivot pin 20′ of the stirrups 19, 19′, and thereby to the channel 5′. The other longitudinally terminal portions of the tension elements 6′ are secured to a connector 18′ as described above with reference to the connector 18.

In the illustrated condition of the modified container, the connector 18′ is not attached to the carrier 9 and the tension elements 6′ are inoperative. If it is desired to install on the carrier 9 a load too heavy for effective control by the tension elements *6a*, *6b*, *6c*, the connector 18′ is additionally attached to the carrier 9 by a suitably widened stirrup 17′ without detaching the connector 18, or the straps 6′ may be substituted for the elements *6a*, *6b*, *6c*, and the connector 18 disconnected from the stirrup 17′ of the modified fastener 8′. For either mode of operation, the tension elements 6′ are preferably chosen to be more or less resilient than each of the elements *6a*, *6b*, *6c*, but some advantages of the modification shown in FIGS. 7 and 8 are available if at least the central element 6′ is less resilient than each of the elements *6a*, *6b*, *6c* or at least the element *6b* is less resilient than each of the elements 6′.

If the same container is normally used for transporting the same load, such as a piece of machinery having a sturdy frame, the carrier 9 may be dispensed with, and the connectors 18 may be attached directly to the machine frame in a conventional manner to maintain the triangular pattern formed by the elements of each suspension unit. The frame may be provided for this purpose with bores in which the pins 22 may be fastened.

The top and bottom faces of the illustrated container are rectangles, but containers having other polygonal top and bottom faces may be equipped with suspension units in an analogous manner. Containers whose top and bottom faces are equilateral hexagons are specifically contemplated because of the close packing possible with such hexagonal containers.

It is a common feature of shipping containers according to the invention that they protect a resiliently suspended load against mechanical shock and excessive oscillation, and against harmful effects of the ambient atmosphere. At least to some extent, they also provide thermal insulation from the environment. The containers can be opened and closed by unskilled operators without the use of tools, and a load may be suspended in the opened container by the unskilled operators who may also remove the load in a simple manner without risking damage if elementary precautions are taken. Particularly when used with a carrier, the containers can transport loads greatly differing in weight and shape, and the package does not contain any loose cushioning material. The outer configuration of the container is readily chosen to permit safe stacking of containers in vertical columns and close, horizontal juxtaposition of individual containers or stacks of containers. Containers of identical outer configuration may be suitable for holding loads differing greatly in weight.

It has been found that actual embodiments of the invention can adequately protect sensitive loads against shock encountered when the container is subjected to acceleration or deceleration at 15 times the value of *g*. The resulting displacement of the load from the normal centered position in the container does not induce significant oscillations of the load when synthetic or natural rubber straps or ropes of adequate strength and different elasticity are used in the individual suspension units described above.

It should be understood, of course, that the foregoing disclosure relates only to preferred embodiments of the invention, and that it is intended to cover all changes and variations in the examples of the invention herein chosen for the purpose of the disclosure which do not constitute departures from the spirit and scope of the invention set forth in the appended claims.

What is claimed is:

1. A shipping container comprising:

a. a shell including a plurality of parts and connecting means for releasably connecting said parts,
   1. the connected parts of the said shell bounding a cavity;

b. a plurality of elongated, rigid base members mounted on said shell in said cavity in spaced relationship;

c. a set of three elongated, resilient tension elements associated with each base member,
   1. each tension element having first and second longitudinally terminal portions;

a. three first fastening means longitudinally spaced on each base member and respectively fastening the first longitudinally terminal portions of the associated tension elements to the base member,
   1. one of said three first fastening means being interposed between the other two first fastening means,
   2. the tension elements fastened to said base member by said other two first fastening means being more resilient than the tension element fastened to said base member by said one first fastening means;

e. second fastening means fastening the second longitudinally terminal portions of said tension elements associated with each base member to each other; and f. attaching means for attaching said second fastening means to a load suspended in said cavity by said tension elements,
   1. said associated tension elements converging from said first toward said second fastening means.

2. A shipping container as set forth in claim 1, wherein said tension elements consist essentially of elastomeric material, the modulus of elasticity of the material in the tension element fastened to said base member by said one first fastening means being higher than the modulus of elasticity of the material in the tension elements fastened to said base member by said other two first fastening means.

3. A shipping container as set forth in claim 1, wherein said shell has a polygonal top face, a polygonal bottom face, and side edges connecting respective corners of said faces, said base member extending along respective side edges, said three first fastening means being secured respectively to the two longitudinal end portions and to a longitudinal central portion of said base member, said end portions being offset from said central portion toward a load suspended by said tension members.

4. A shipping container as set forth in claim 3, wherein said second fastening means include a connector member secured to the second longitudinally terminal portions of the tension elements associated with each base member, and said attaching means include means for attaching said connector member to said load.

5. A shipping container as set forth in claim 4, further comprising a carrier for said load, said attaching means attaching said carrier to said connector member, said tension elements being stressed under tension when said connector members are attached to said carrier.

6. A shipping container as set forth in claim 3, mounting means releasably mounting each base member to said shell in said cavity.

7. A shipping container as set forth in claim 6, further comprising reinforcing ribs on said shell extending along respective side edges, said mounting means releasably mounting said base members to said reinforcing ribs.

8. A shipping container as set forth in claim 1, further comprising a carrier adapted to carry said load and attached by said attaching means to said tension elements, said base members being elongated in a common direction transverse to said tension elements, each base member having two longitudinal end portions and a central portion, said three first fastening means being secured to said portions of said base member respectively, said end portions defining a line of reference, and said central portion being offset from said line in a direction away from said carrier.

9. A shipping container as set forth in claim 8 wherein said sets of tension elements extend in respective common planes, said planes angularly intersecting each other in said carrier.

10. A shipping container as set forth in claim 1, further comprising three additional, elongated, resilient tension elements associated with each base member, each of said additional tension elements having first and second longitudinally terminal portions; three third fastening means longitudinally spaced on each base member and respectively fastening the first longitudinally terminal portions of each of said associated additional tension members to said base member, at least one of the associated additional tension elements being less resilient than the tension elements of the set fastened to the same base member by said first fastening means; and fourth fastening means for fastening the second longitudinally terminal portions of the three additional tension elements associated with each base member to each other and to said load.

* * * * *

UNITED STATES PATENT OFFICE

CERTIFICATE OF CORRECTION

Patent No. 4,013,170 Dated March 22, 1977

Inventor(s) Karl Hutterer

It is certified that error appears in the above-identified patent and that said Letters Patent are hereby corrected as shown below:

In the heading, Item (73) "Dornier System GmbH" should read -- Dornier GmbH --.

Signed and Sealed this

Fourteenth Day of June 1977

[SEAL]

*Attest:*

RUTH C. MASON
*Attesting Officer*

C. MARSHALL DANN
*Commissioner of Patents and Trademarks*